US006875954B2

(12) United States Patent
DeBenedetto et al.

(10) Patent No.: US 6,875,954 B2
(45) Date of Patent: Apr. 5, 2005

(54) HIDDEN HEAT STRIP FOR ROOFS

(76) Inventors: Richard S. DeBenedetto, 11 Sanborn St., Danville, NH (US) 03819; Thomas F. Johnson, 34 Somerset Dr., Salem, NH (US) 03079

( * ) Notice: Subject to any disclaimer, the term of this patent is extended or adjusted under 35 U.S.C. 154(b) by 0 days.

(21) Appl. No.: 10/298,416

(22) Filed: Nov. 18, 2002

(65) Prior Publication Data

US 2004/0094530 A1 May 20, 2004

(51) Int. Cl.[7] ..... H05B 1/00

(52) U.S. Cl. ..... 219/213; 219/212; 219/528; 219/544; 219/549; 392/435

(58) Field of Search ..... 219/213, 211, 219/212, 217, 385, 386, 520, 528, 529, 544, 549; 392/425, 432, 433, 435, 436, 437

(56) References Cited

U.S. PATENT DOCUMENTS

| | | | | | |
|---|---|---|---|---|---|
| 2,111,251 | A | * | 3/1938 | Spilsbury | 392/432 |
| 2,699,484 | A | | 1/1955 | Michaels | 219/19 |
| 2,844,696 | A | * | 7/1958 | Custer, Jr. | 219/213 |
| 3,691,343 | A | | 9/1972 | Norman | 219/213 |
| 4,769,526 | A | | 9/1988 | Taouil | 219/213 |
| 5,391,858 | A | | 2/1995 | Tourangeau et al. | 219/213 |
| 5,643,482 | A | * | 7/1997 | Sandelman et al. | 219/213 |
| 5,786,563 | A | | 7/1998 | Tiburzi | 219/213 |
| 6,124,571 | A | | 9/2000 | Miller et al. | 219/213 |
| 6,166,352 | A | | 12/2000 | Turton | 219/213 |
| 6,211,493 | B1 | * | 4/2001 | Bouman | 219/213 |
| 6,225,600 | B1 | * | 5/2001 | Burris | 219/213 |
| 6,483,086 | B1 | * | 11/2002 | Wolff et al. | 219/528 |
| 6,646,226 | B1 | * | 11/2003 | Reitz | 219/528 |

* cited by examiner

*Primary Examiner*—Fadi H. Dahbour
(74) *Attorney, Agent, or Firm*—Pearson & Pearson, LLP

(57) ABSTRACT

A hidden heat strip for providing heat at the edge of a roof to prevent formation of ice. Each heat strip comprises a plurality of triangular-shaped assemblies having a heat cable inserted from under the assemblies and positioned adjacent to a notched front panel. Support clips extend from a bottom portion and a vented top panel is disposed above the heat cable. Spaced-apart reinforcement ribs are located between side panels of the assemblies to support shingles and prevent sagging. The heat strip is placed between rows of shingles and is not easily observed from the ground level.

52 Claims, 5 Drawing Sheets

HIDDEN HEAT STRIP FOR ROOFS

BACKGROUND OF THE INVENTION

1. Field of the Invention

This invention relates generally to preventing the build-up of snow and ice on the lower portion and edge of a roof and in particular to heat strips for roofs that fit under existing or new shingles and are not easily seen from any view of the roof.

2. Description of Related Art

In roofs located in cold climates where there is an accumulation of snow and ice, ice forms at roof margins during the winter and then the ice overhangs the edge of the roof forming icicles and backs-up into soffit vents. The ice forms dams on the roof itself and continues to build in size as the snow melts from further up the roof. These dams hold the water from running off the roof's edge. As the water builds it works its way under the shingles above it. Once the water makes its way under the shingle, the water drips into the attic space damaging insulation, wall boards, ceilings, and any building materials below. Solutions to this problem have included heat strips made with wire which are attached to the outside of shingles in a zigzag pattern resulting in not only a rather unsightly appearance but also it is only efficient at these drip points or the point of the heating wires closest to the roof edge.

U.S. Pat. No. 2,699,484, issued Jan. 11, 1955, to Hebert L. Michaels, discloses a de-icer for roofs comprising a hollow shingle-shaped casing forming an extension of a roof and attaching to the trim boards of the roof and having an electrically conductive conduit in said casing. However, this de-icer changes the appearance of the roof line.

U.S. Pat. No. 3,691,343, issued Sep. 12, 1972, to Victor B. Norman, discloses a modular system of sheet metal de-icing shingles and valley sections for preventing the build-up of ice at the eaves of a roof having fine heater-wires arranged in a trapezoid configuration on the under surface of the shingles. However, this modular system presents an unsightly appearance of the roof on a house.

U.S. Pat. No. 4,769,526, issued Sep. 6, 1988, to Tony F. Taouil, discloses a roof de-icing panel which also replaces one or more lower courses of shingles. It includes a perforated metal portion extending from the gutter to prevent debris from clogging the gutter, but it does not melt water flowing into it. Also, the roof deicing panel changes the roof edge appearance.

U.S. Pat. No. 5,391,858, issued Feb. 21, 1995, to David R. Tourangeau discloses an ice dam melting system in the form of a hollow heat cell panel which replaces the last course of shingles at the edge of the roof, a conduit supported by the lower panel, an upper panel formed of metal and connected to and supported by said conduit, and a heat-generating mechanism in the conduit. However, this system changes the appearance of the roof edge.

U.S. Pat. No. 5,786,563, issued Jul. 28, 1998, to Anita Tiburzi, discloses modular ice and snow removal panels with gutter exclusion valves for removing snow and ice and which includes a series of panels aligned in end-to-end fashion along a roof eave and atop the edge rows of shingles. The panels each include internally arrayed beating elements and an electrically operated valve element proximate a lower edge for the purpose of channeling melted ice and snow either into or over a conventionally secured gutter. However, such modular ice and snow removal panels change the appearance of the roof on a house.

U.S. Pat. No. 6,166,352, issued Dec. 26, 2000, to Kenneth Turton, discloses an ice shield for eaves of a roof comprising at least one continuously wound roll of a flexible and elongate mat of material which includes a first exposed face and a second reverse side face. The elongate mat is constructed of first and second layers of a durable rubberized material capable of convecting heat generated by generally longitudinal extending coils embedded between the layers. An adhesive coating is applied to the reverse side face and covered with a release tape. The mat is unrolled and positioned atop and along an eave edge location of the roof. The ice shield is installed underneath one or more initial rows of shingles to melt ice deposits. However, on existing homes, shingles have to be removed to install the mat, and in many cases it is necessary to match the shingle color due to aging which may be difficult. A professional roofer is generally required to perform the installation of such a mat, not a handy homeowner.

SUMMARY OF THE INVENTION

Accordingly, it is an object of this invention to provide a heat strip for a roof that is not observed from ground level to prevent ice build-up.

It is another object of this invention to provide a plurality of heat strips for preventing ice build-up that are positioned between shingles of a roof.

It is a further object of this invention to provide clips on the underside of the heat strip to hold it in place on the roof.

It is still another object of this invention to provide a molded one-piece triangular-shaped heat strip for repeated use along a lower portion of a roof.

It is another object of this invention to keep the roof's edge clear so that melting snow or water can flow freely off the roof's edge and prevent injury due to falling icicles.

It is another object of this invention to provide a heat strip for melting ice and snow on a lower portion of a roof of an existing house that is easily installed by a homeowner.

These and other objects are accomplished by a heat strip for preventing ice build-up on a roof comprising an enclosure having a predetermined shape for easy insertion under a shingle on the roof, a heat cable positioned within the enclosure, a front panel of the enclosure comprises a plurality of spaced-apart notches, and a top surface of the enclosure comprises a plurality of spaced-apart slots. The enclosure comprises a plurality of reinforcement ribs spaced-apart between a first end panel and a second end panel to provide support. The predetermined shape for the enclosure comprises a triangular shape for easy insertion under a shingle. The enclosure comprises a support clip protruding from a bottom surface of the enclosure. The enclosure comprises means for retaining the heat cable within the enclosure. The means for retaining the heat cable comprises an opening in each of the first end panel, the second end panel and the plurality of reinforcement ribs for inserting and holding the heat cable. A controller is connected to the heat cable of the heat strip for turning ON and turning OFF the heat cable in response to predetermined signals from an outside temperature sensor. The controller comprises a display for indicating the temperature within the enclosure, the temperature being measured by a temperature sensor coupled to said controller and positioned in the enclosure.

The objects are further accomplished by a heat strip for preventing ice build-up on a roof comprising a triangular-shaped enclosure having a bottom portion, a front panel, a top panel, a first end panel and a second end panel, the front panel having a plurality of spaced-apart notches and the top panel having a plurality of spaced-apart slots, a plurality of reinforcement ribs spaced-apart between the first end panel and the second end panel to provide support for the triangular-shaped enclosure, a heat cable positioned within the enclosure, and each of the first end panel, the second end panel and the plurality of reinforcement ribs comprises an opening for receiving the heat cable. The triangular-shaped enclosure comprises a support clip extending from the bottom portion of the enclosure. The opening for receiving the cable comprises a first narrow portion for the cable to enter and a second wider portion for holding the cable. A controller is connected to the heat cable of the heat strip for turning ON and turning OFF the heat cable in response to predetermined signals from an outside temperature sensor. The controller comprises a display for indicating the temperature within the enclosure, the temperature being measured by a temperature sensor coupled to said controller and positioned in the enclosure.

The objects are further accomplished by an apparatus for preventing formation of ice on a lower portion of a roof comprising a plurality of rows of heat strips inserted under corresponding rows of shingles on the roof, each of the rows of heat strips comprises a plurality of enclosures, positioned side-by-side, each of said enclosures, having a bottom portion, a front panel, a top panel, a first end panel and a second end panel, the front panel having a plurality of spaced-apart notches and the top panel having a plurality of spaced-apart slots, each of the enclosures comprises a plurality of reinforcement ribs spaced-apart between the first end panel and the second end panel to provide support for the enclosures, and a heat cable, positioned within each of the plurality of enclosures and extending along each of the rows of heat strips, for supplying heat to melt the ice. Each of the enclosures comprises means for receiving the heat cable and retaining the heat cable adjacent to the front panel of each of the enclosures. Each of the enclosures comprises a triangular-shape, and a support clip extends from the bottom portion of the enclosures. Each of the first end panel, the second end panel, and the plurality of reinforcement ribs comprises an opening for receiving the heat cable. The opening for receiving the cable comprises a first narrow portion for the cable to enter and a second wider portion for holding the cable. A controller is connected to the heat cable of the heat strip for turning ON and turning OFF the heat cable in response to predetermined signals from an outside temperature sensor. The controller comprises a display for indicating the temperature within the enclosure, the temperature being measured by a temperature sensor coupled to said controller and positioned in the enclosure.

The objects are further accomplished by a method of preventing formation of ice on a lower portion of a roof comprising the steps of inserting a plurality of rows of heat strips under corresponding rows of shingles on the roof, providing along each of the rows of heat strips a plurality of enclosures, positioned side-by-side, having a bottom portion, a front panel, a top panel, a first end panel and a second end panel, the front panel having a plurality of spaced-apart notches and the top panel having a plurality of spaced-apart slots, providing support for the enclosures with a plurality of reinforcement ribs spaced-apart between the first end panel and the second end panel, and positioning a heat cable within each of the plurality of enclosures along each of the plurality of rows of heat strips, for supplying heat to melt the ice. The step of providing the enclosures along each of the plurality of rows of heat strips comprises the step of providing means to receive the heat cable and retaining the heat cable adjacent to the front panel of each of the enclosures. The method comprises the step of providing a support clip extending from the bottom portion of each of the enclosures. The step of providing the enclosures each having the first end panel, the second end panel, and the plurality of reinforcement ribs comprises the step of providing an opening to receive the heat cable. The step of providing an opening to receive the heat cable comprises the step of providing the opening with a first narrow portion for the heat cable to enter and a second wider portion for holding the heat cable. The method comprises the step of providing the enclosures with a triangular-shape for easy insertion under the shingles on the roof. The method comprises the step of controlling the operation of the heat strip by turning ON and turning OFF the heat strip in response to predetermined signals from an outside temperature sensor. The method comprises the step of measuring a temperature within the enclosure, and displaying the temperature on a display.

The objects are further accomplished by an enclosure for a heat strip comprising a bottom surface, a front wall having a plurality of spaced-apart notches, a top surface having a plurality of spaced-apart slots, a front edge of the top surface being attached to a top portion of the front wall, a rear edge of the top surface being attached to the rear edge of the bottom surface, a first end panel and a second end panel, each positioned between the top surface and the bottom surface, and a plurality of reinforcement ribs spaced-apart between the first end panel and the second end panel to provide support between the top surface and the bottom surface. The enclosure comprises a support clip extending from the bottom surface. Each of the first end panel, the second end panel and the plurality of reinforcement ribs comprises means for retaining a heat cable within the enclosure. The means for retaining a heat cable within the enclosure comprises an opening having a first narrow portion for the heat cable to enter and a second wider portion for holding the heat cable.

Additional objects, features and advantages of the invention will become apparent to those skilled in the art upon consideration of the following detailed description of the preferred embodiments exemplifying the best made of carrying out the invention as presently perceived.

BRIEF DESCRIPTION OF THE DRAWINGS

The appended claims particularly point out and distinctly claim the subject matter of this invention. The various objects, advantages and novel features of this invention will be more fully apparent from a reading of the following detailed description in conjunction with the accompanying drawings in which like reference numerals refer to like parts, and in which:

DESCRIPTION OF ILLUSTRATIVE EMBODIMENTS

Figure 1:
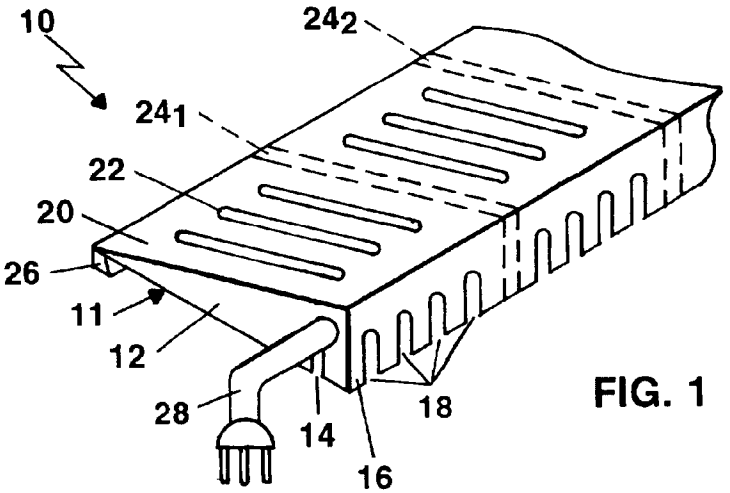
FIG. 1 is a perspective view of a roof heat strip according to the present invention.

Referring to FIG. 1, a perspective view of a portion of a heat strip 10 for a roof, is shown in accordance with the present invention comprising a triangular-shaped enclosure 11 and a heat cable 28 inserted within the triangular-shaped enclosure 11 adjacent to a front panel 16 having a plurality of notches 18 for heat venting. Enclosure 11 comprises a top panel having a plurality of slot vents to enable heat to escape to heat roof shingles when installed on a roof for melting snow or ice. A side panel 12 of enclosure 11 comprises an opening 14 for receiving the heat cable 28. The heat strip 10 may be applied to a new roof by a roofer or it may be applied to an existing roof or portions of an existing roof by a homeowner.

The heat strip 10 is very small in height, so that it is easily inserted under shingles of an existing roof. Typically the height of the front panel 16 is approximately ⅛ inch, which results in the heat strip 10 essentially being hidden on a roof. The depth of the side panel 12 is typically four inches, and the length of the front panel 16 is typically thirty-six inches. Other dimensions of the heat strip 10 are equally feasible.

Figure 2:
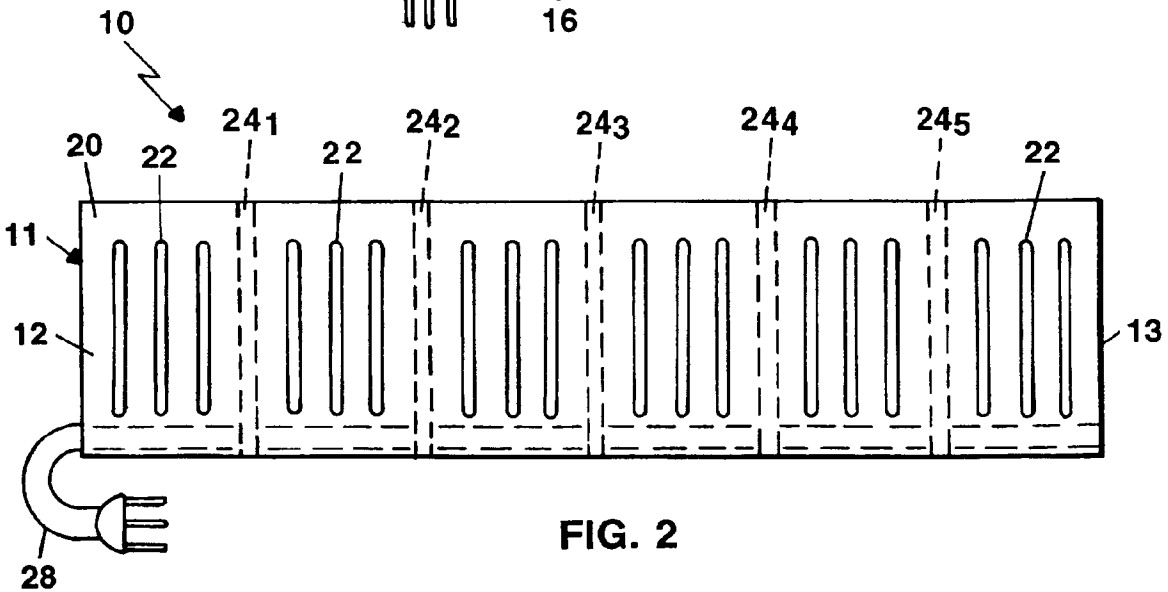
FIG. 2 is a top view of the roof heat strip.
Figure 7:
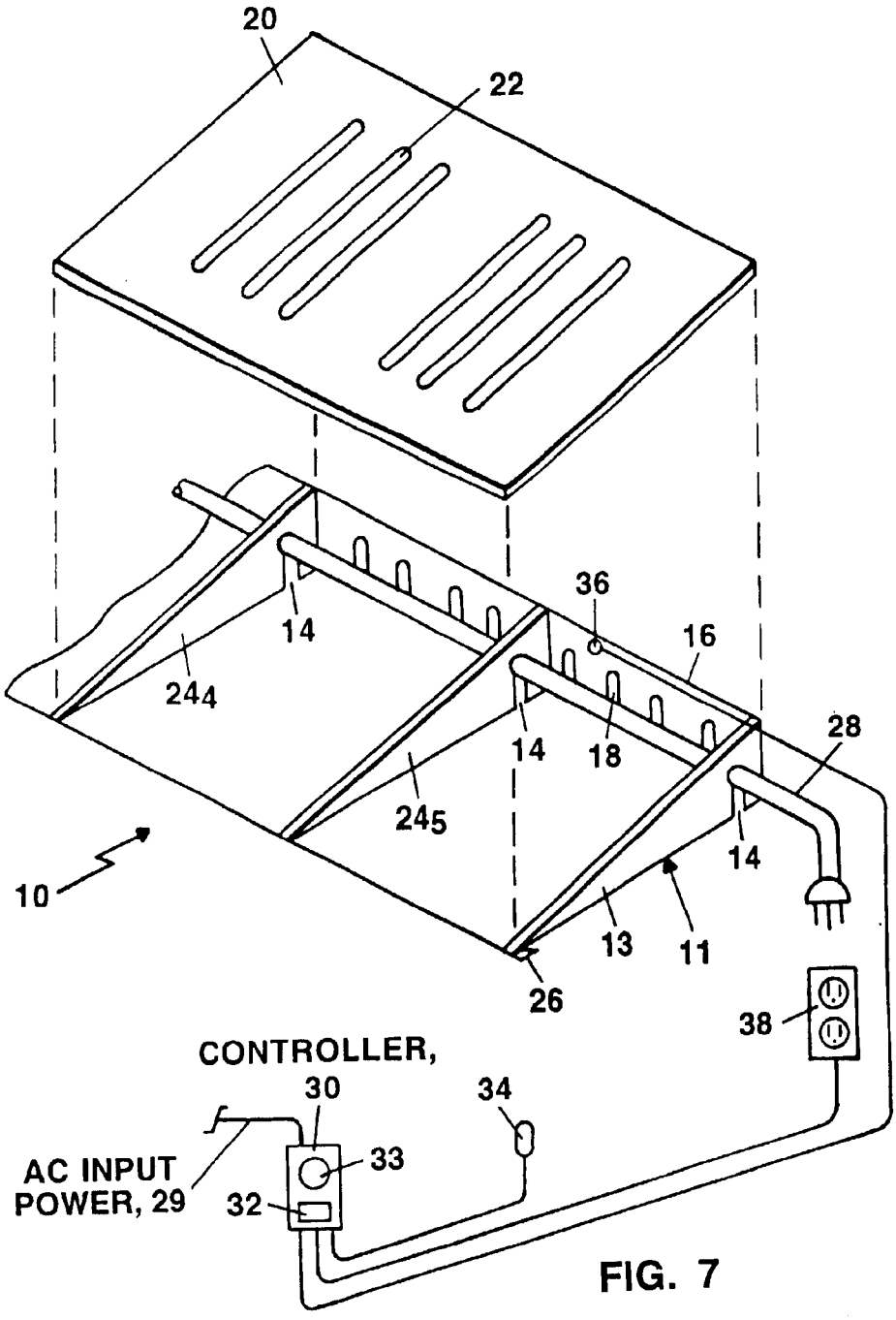
FIG. 7 is an exploded rear perspective view of the roof heat strip showing the reinforcement ribs, and a pictorial view of an AC power controller with temperature sensors.

Referring to FIG. 1 and FIG. 2, FIG. 2 is a top view of the roof heat strip 10 showing a plurality of reinforcement ribs $\mathbf{24}_1$ to $\mathbf{24}_5$ which are approximately equally spaced apart between a first end panel 12 and an opposite second end panel 13 (FIG. 7). FIGS. 1 and 2 show three slot vents 22 between the reinforcement ribs $\mathbf{24}_1$ to $\mathbf{24}_5$; however, the number of such slot vents 22 may be varied depending on the length the triangular-shaped enclosure 11 and the spacing of the reinforcement ribs $\mathbf{24}_1$ to $\mathbf{24}_5$ between the first end panel 12 and the opposite second end panel 13. Each of the first end panel 12, second end panel 13, and reinforcement ribs $\mathbf{24}_1$ to $\mathbf{24}_5$ comprises the opening 14 in a bottom portion having a narrow entrance which flares out to accommodate the size of a heat cable 28 which is pushed through the narrow entrance and retained within the opening 14.

Figure 3:
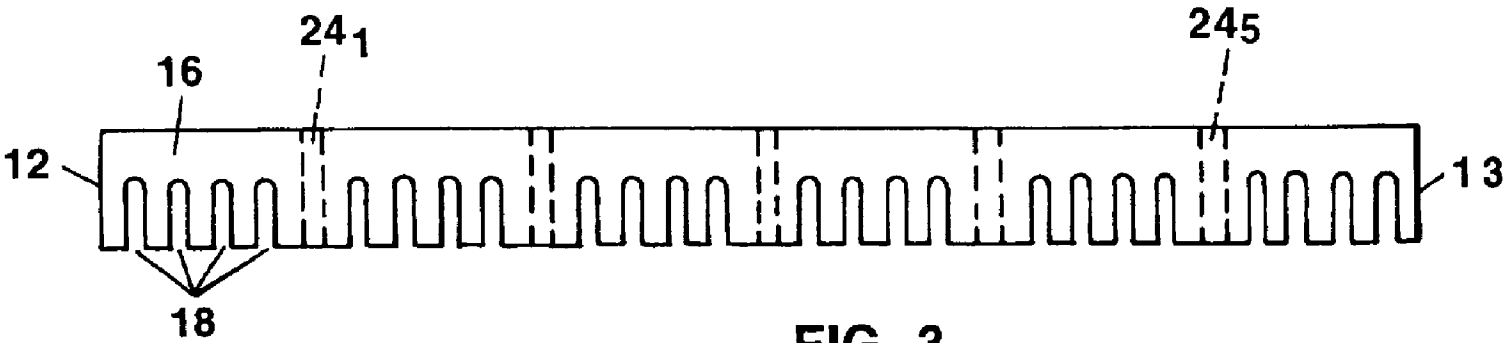
FIG. 3 is a front elevational view of the roof heat strip.

Referring to FIG. 3, a front elevational view of the roof heat strip 10 is shown. The front panel 16 comprises a plurality of approximately equally spaced notches 18 for allowing heat to escape and melt any build-up of snow or ice. FIG. 3 shows that in the preferred embodiment there are four of the notches 18 between the end panels 12 and reinforcement rib $\mathbf{24}_1$, between the reinforcement ribs $\mathbf{24}_2$ to $\mathbf{24}_5$, and between reinforcement rib $\mathbf{24}_5$ and the second end panel 13. However, the number of such notches 18 may be varied depending on the length of the triangular-shaped enclosure 11, the number of reinforcement ribs 24 and the width of each notch 18.

Figure 4:
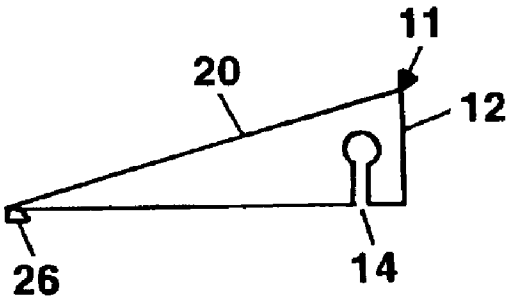
FIG. 4 is a side elevational view of the triangular-shaped enclosure of the roof heat strip.

Referring now to FIG. 4, FIG. 4 is a side elevational view of the triangular-shaped enclosure 11. It also represents the side view of each reinforcement ribs $\mathbf{24}_1$ to $\mathbf{24}_5$ showing the opening 14 for receiving the heat cable 28. The triangular-shaped enclosure 11 comprises the top panel 20 and the front panel 12 and a support clip 26 extending from a rear bottom portion of the enclosure 11 for retaining the triangular-shaped enclosure 11 between layers of shingles on a roof. The triangular-shaped enclosure 11 may be embodied with a molded plastic such as polypropylene having a 94 V-O rating for use with 110 VAC made by a molding process which is commonly known in the art, and such plastic may be embodied by Model PP-301 manufactured by Polyone Engineering Materials and sold by W. K. Hillquist, Inc., of Hudson, N.H.

Figure 5:
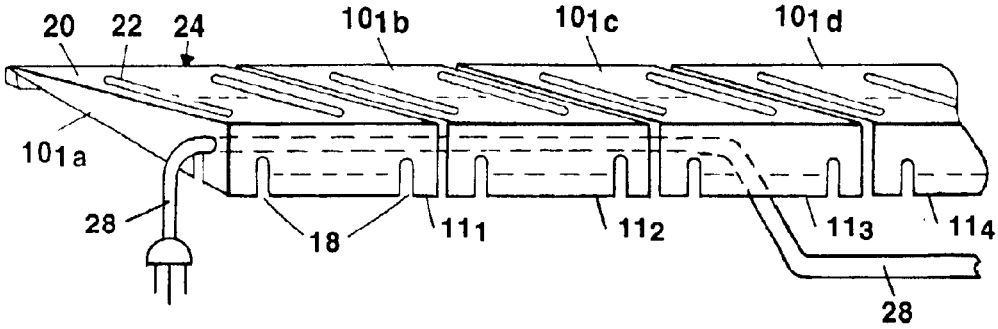
FIG. 5 is a perspective view of a plurality of roof heat strips positioned adjacent to each other showing the heat cable attached to two of the heat strips and being attached to a third heat strip.
Figure 6:
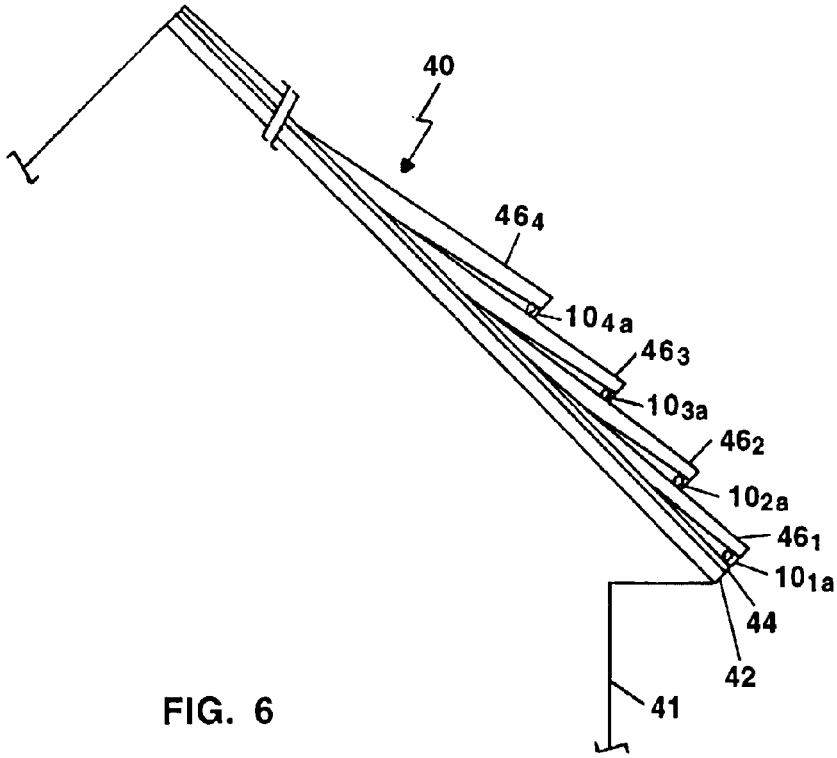
FIG. 6 is an enlarged side elevational view of a roof having a plurality of roof heat strips installed within shingle layers above a roof soffit area.

Referring now to FIG. 5 and FIG. 6, FIG. 5 is a front perspective view of a plurality of roof heat strips $\mathbf{10}_{1a}$ to $\mathbf{10}_{1d}$ positioned adjacent to each other showing the heat cable 28 attached within two of the triangular-shaped enclosures $\mathbf{11}_1$ and $\mathbf{11}_2$ and partially inserted within the triangular-shaped enclosure $\mathbf{11}_3$ adjacent to triangular-shaped enclosure $\mathbf{11}_4$. As the heat cable 28 is inserted completely through each triangular-shaped enclosure $\mathbf{11}_1$ to $\mathbf{11}_4$, that enclosure may be inserted under shingle $\mathbf{46}_1$, between shingles $\mathbf{46}_1$ and $\mathbf{46}_2$ and between shingles $\mathbf{46}_2$ and $\mathbf{46}_3$, etc. as shown in FIG. 6.

Referring to FIG. 6, an enlarged side elevational view of a roof 40 of a structure 41 comprising a plurality of parallel heat strips $\mathbf{10}_1$ to $\mathbf{10}_n$ installed, where "n" is the number of rows of heat strips inserted under shingle layers $\mathbf{46}_1$ to $\mathbf{46}_L$ that need the heat strips $\mathbf{10}_1$ to $\mathbf{10}_n$ to prevent ice build-up. Also, the roof 40 comprises sheathing 42, a layer of water and ice melt protector 44 placed over a lower portion of the sheathing 42 followed by the layers of shingles $\mathbf{46}_1$ to $\mathbf{46}_L$.

Referring to FIG. 7, an exploded rear perspective view of the roof heat strip 10 shows the top panel 20 of the triangular-shaped enclosure 11 raised exposing the reinforcement ribs $\mathbf{24}_4$ to $\mathbf{24}_5$. Each of the reinforcement ribs $\mathbf{24}_4$ and $\mathbf{24}_5$ and the second end panel 13 comprise the opening 14 for holding the heat cable 28 within the triangular-shaped enclosure 11.

Still referring to FIG. 7, FIG. 7 further shows a pictorial view of an AC power controller 30 provided for mounting inside a house structure 41. The controller 30 comprises a thermostat relay (not shown) for switching the AC voltage to the heat cable 28 when plugged into AC outlet 38, and a digital display 32 for monitoring the temperature within the triangular-shaped enclosure 11. An outside air temperature sensor 34 is mounted to the side of the house structure 41 and connected to the thermostat relay. The thermostat relay comprises a temperature set adjustment 33 which determines the temperature at which the heat cable 28 is turned-on when the temperature sensor 34 reaches the set temperature. A temperature sensor 36 is attached to the front panel 16 of the enclosure 11 for sensing the temperature within the enclosure 11 under the shingles. The ground fault interrupt (GFI) AC outlet 38 is mounted in the soffit area under the roof 40 for plugging-in the heat cable 28. The GFI outlet 38 receives the AC voltage input from the controller 30 when the outside temperature reaches the temperature set on the temperature set adjustment 33 of the thermostat relay. The controller 30 including the thermostat relay may be embodied by model AMC-55 manufactured by Tyco Thermal Control of Menlo Park, Calif. 94025.

Figure 8:
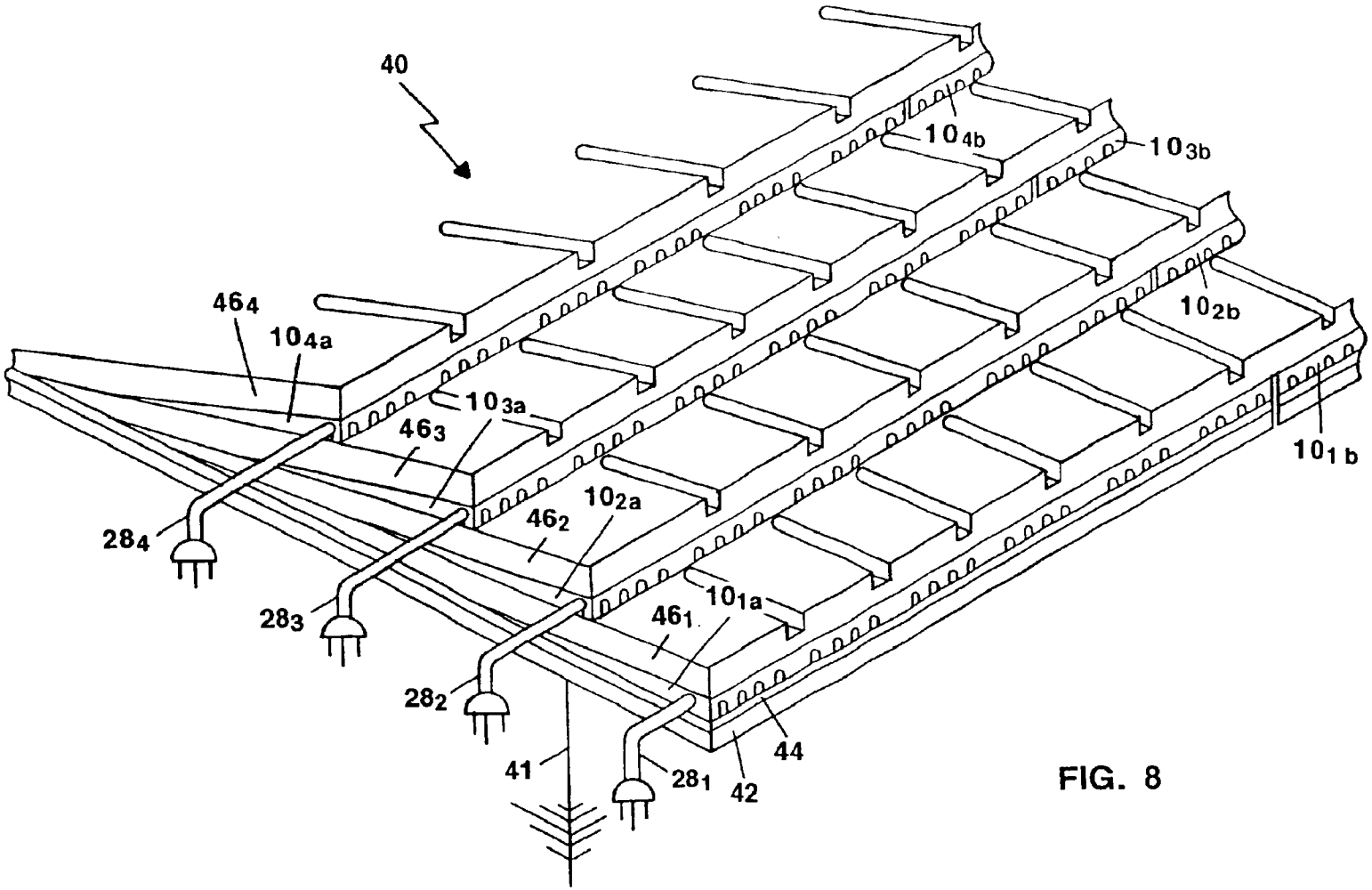
FIG. 8 is an enlarged perspective view of a roof comprising heat strips installed under the shingles on the lower portion of the roof according to the present invention.

Referring to FIG. 8, an enlarged perspective view of the roof 40 is shown comprising the plurality of rows of heat strips $\mathbf{10}_1$–$\mathbf{10}_n$ installed under the layers of shingles $\mathbf{46}_1$–$\mathbf{46}_n$ on the lower portion of the roof 40 and in particular in the layers of shingles $\mathbf{46}_1$ and $\mathbf{46}_2$ extending beyond the house structure 41. Each layer of shingles, such as shingles $\mathbf{46}_1$ comprises a series of heat strips $\mathbf{10}_{1a}$, $\mathbf{10}_{1b}$ . . . $\mathbf{10}_{1n}$ inserted under shingles $\mathbf{46}_1$ across the width of the roof 40. Because of the low height of the heat strips $\mathbf{10}_1$–$\mathbf{10}_n$, they are essentially hidden from view on ground level. As described above, in preferred embodiments of the heat strip 10, such as heat strips $10_{1a}$, $10_{2a}$, $10_{3a}$, and $10_{4a}$, the height is ⅛ inch, the depth extending under the shingles $46_1$–$46_4$ is 4 inches and the length is 3 feet. However, the heat strips 10 may have varying dimensions depending on design choice.

The heat cable 28 may be embodied by Model GM-1XT manufactured by Tyco Thermal Control of Menlo Park, Calif. 94025. The cable is available in at least 30', 40', 50', and 60' lengths. Each length of cable will have a male and female end in order to connect cables together. As described above, the cable operates at 110 volts AC controlled by the 110 volt thermostat relay of controller 30, and the sensor 34 measures the outside air temperature. The cable controller 30 also has a display 32 for showing the temperature measured inside the heat strip enclosure 11 when installed under the shingle for monitoring purposes only.

This invention has been disclosed in terms of a certain embodiment. However, it will be apparent that many modifications can be made to the disclosed apparatus without departing from the invention. For example, the number of notches 18 in the front panel 16 may be varied in size and quantity and the number of slots 22 in the top panel 20 may be varied in size and quantity. Therefore, it is the intent of the appended claims to cover all such variations and modifications as come within the true spirit and scope of this invention.

What is claimed is:

1. A heat strip for preventing ice build-up on a roof comprising:

an enclosure having a triangular-shape for easy insertion under a shingle on the roof;

a heat cable positioned within said enclosure;

a front panel of said enclosure comprises a plurality of spaced-apart open notches for heated air to escape; and a top surface of said enclosure comprises a plurality of spaced-apart slots vents.

2. The heat strip as recited in claim 1 wherein said enclosure comprises a plurality of reinforcement ribs spaced-apart between a first end panel and a second end panel to provide support.

3. The heat strip as recited in claim 1 wherein said enclosure comprises a support clip protruding from a bottom surface of said enclosure.

4. The heat strip as recited in claim 2 wherein said enclosure comprises means for retaining the heat cable within said enclosure.

5. The heat strip as recited in claim 4 wherein said means for retaining said heat cable comprises an opening in each of said first end panel, said second end panel and said plurality of reinforcement ribs for inserting and holding said heat cable.

6. The heat strip as recited in claim 1 wherein a controller is connected to said heat cable of said heat strip for turning ON and turning OFF said heat cable in response to predetermined signals from an outside temperature sensor.

7. The heat strip as recited in claim 6 wherein said controller comprises a display for indicating the temperature within said enclosure, said temperature being measured by a temperature sensor coupled to said controller and positioned in said enclosure.

8. A heat strip for preventing ice build-up on a roof comprising:

a triangular-shaped enclosure having a bottom portion, a front panel, a top panel, a first end panel and a second end panel, said front panel having a plurality of spaced-apart notches and said top panel having a plurality of spaced-apart slots;

a plurality of reinforcement ribs spaced-apart between said first end panel and the second end panel to provide support for said triangular-shaped enclosure;

a heat cable positioned within said enclosure; and each of said first end panel, said second end panel and said plurality of reinforcement ribs comprises an opening for receiving said heat cable.

9. The heat strip as recited in claim 8 wherein said triangular-shaped enclosure comprises a support clip extending from said bottom portion of said enclosure.

10. The heat strip as recited in claim 8 wherein said opening for receiving said cable comprises a first narrow portion for said cable to enter and a second wider portion for holding said cable.

11. The heat strip as recited in claim 8 wherein a controller is connected to said heat cable of said heat strip for turning ON and turning OFF said heat cable in response to predetermined signals from an outside temperature sensor.

12. The heat strip as recited in claim 11 wherein said controller comprises a display for indicating the temperature within said enclosure, said temperature being measured by a temperature sensor coupled to said controller and positioned in said enclosure.

13. Apparatus for preventing formation of ice on a lower portion of a roof comprising:

a plurality of rows of heat strips inserted under corresponding rows of shingles on said roof;

each of said rows of heat strips comprises a plurality of enclosures, positioned side-by-side, each of said enclosures, having a bottom portion, a front panel, a top panel, a first end panel and a second end panel, said front panel having a plurality of spaced-apart notches and said top panel having a plurality of spaced-apart slots;

each of said enclosures comprises a plurality of reinforcement ribs spaced-apart between said first end panel and said second end panel to provide support for said enclosures; and a heat cable, positioned within each of said plurality of enclosures and extending along each of said rows of heat strips, for supplying heat to melt said ice.

14. The apparatus as recited in claim 13 wherein each of said enclosures comprises means for receiving said heat cable and retaining said heat cable adjacent to said front panel of each of said enclosures.

15. The apparatus as recited in claim 13 wherein each of said enclosures comprises a triangular-shape, and a support clip extends from said bottom portion of said enclosures.

16. The heat strip as recited in claim 13 wherein each of said first end panel, said second end panel, and said plurality of reinforcement ribs comprises an opening for receiving said heat cable.

17. The heat strip as recited in claim 16 wherein said opening for receiving said cable comprises a first narrow portion for said cable to enter and a second wider portion for holding said cable.

18. The heat strip as recited in claim 13 wherein a controller is connected to said heat cable of said heat strip for turning ON and turning OFF said heat cable in response to predetermined signals from an outside temperature sensor.

19. The heat strip as recited in claim 18 wherein said controller comprises a display for indicating the temperature within said enclosure, said temperature being measured by a temperature sensor coupled to said controller and positioned in said enclosure.

20. A method of preventing formation of ice on a lower portion of a roof comprising the steps of:

inserting a plurality of rows of heat strips under corresponding rows of shingles on said roof;

providing along each of said rows of heat strips a plurality of enclosures, positioned side-by-side, having a bottom portion, a front panel, a top panel, a first end panel and a second end panel, said front panel having a plurality of spaced-apart notches and said top panel having a plurality of spaced-apart slots;

providing support for said enclosures with a plurality of reinforcement ribs spaced-apart between said first end panel and said second end panel; and positioning a heat cable within each of said plurality of enclosures along each of said plurality of rows of heat strips, for supplying heat to melt said ice.

21. The method as recited in claim 20 wherein said step of providing said enclosures along each of said plurality of rows of heat strips comprises the step of providing means to receive said heat cable and retaining said heat cable adjacent to said front panel of each of said enclosures.

22. The method as recited in claim 20 wherein said method comprises the step of providing a support clip extending from said bottom portion of each of said enclosures.

23. The method as recited in claim 20 wherein each said step of providing said enclosures having said first end panel, said second end panel, and said plurality of reinforcement ribs comprises the step of providing an opening to receive said heat cable.

24. The method as recited in claim 23 wherein said step of providing an opening to receive said heat cable comprises the step of providing said opening with a first narrow portion for said heat cable to enter and a second wider portion for holding said heat cable.

25. The method as recited in claim 20 wherein said method comprises the step of providing said enclosures with a triangular-shape for easy insertion under said shingles on said roof.

26. The method as recited in claim 20 wherein said method comprises the step of controlling the operation of said heat strip by turning ON and turning OFF said heat strip in response to predetermined signals from an outside temperature sensor.

27. The method as recited in claim 26 wherein said method comprises the step of measuring a temperature within said enclosure, and displaying said temperature on a display.

28. An enclosure for a heat strip comprising:

a bottom surface;

a front wall having a plurality of spaced-apart notches;

a top surface having a plurality of spaced-apart slots, a front edge of said top surface being attached to a top portion of said front wall, a rear edge of said top surface being attached to said rear edge of said bottom surface;

a first end panel and a second end panel, each positioned between said top surface and said bottom surface; and a plurality of reinforcement ribs spaced-apart between said first end panel and said second end panel to provide support between said top surface and said bottom surface.

29. The enclosure as recited in claim 28 wherein said enclosure comprises a support clip extending from said bottom surface.

30. The enclosure as recited in claim 28 wherein each of said first end panel, said second end panel and said plurality of reinforcement ribs comprises means for retaining a heat cable within said enclosure.

31. The enclosure as recited in claim 30 wherein said means for retaining a heat cable within said enclosure comprises an opening having a first narrow portion for said heat cable to enter and a second wider portion for holding said heat cable.

32. A heat strip for preventing ice build-up on a roof comprising:

an enclosure having a predetermined shape for easy insertion under a shingle on the roof;

said enclosure comprises a plurality of reinforcement ribs spaced-apart between a first end panel and a second end panel to provide support;

a heat cable positioned within said enclosure;

a front panel of said enclosure comprises a plurality of spaced-apart notches; and a top surface of said enclosure comprises a plurality of spaced-apart slots.

33. The heat strip as recited in claim 32 wherein said predetermined shape for said enclosure comprises a triangular shape for easy insertion under a shingle.

34. The heat strip as recited in claim 32 wherein said enclosure comprises a support clip protruding from a bottom surface of said enclosure.

35. The heat strip as recited in claim 32 wherein said enclosure comprises means for retaining the heat cable within said enclosure.

36. The heat strip as recited in claim 35 wherein said means for retaining said heat cable comprises an opening in each of said first end panel, said second end panel and said plurality of reinforcement ribs for inserting and holding said heat cable.

37. The heat strip as recited in claim 32 wherein a controller is connected to said heat cable of said heat strip for turning ON and turning OFF said heat cable in response to predetermined signals from an outside first temperature sensor.

38. The heat strip as recited in claim 37 wherein said controller comprises a display for indicating the temperature within said enclosure, said temperature being measured by a second temperature sensor coupled to said controller and positioned in said enclosure.

39. A heat strip for preventing ice build-up on a roof comprising:

an enclosure having a triangular shape for easy insertion under a shingle on the roof;

a heat cable positioned within said enclosure;

a front panel of said enclosure comprises a plurality of spaced-apart notches; and a top surface of said enclosure comprises a plurality of spaced-apart slots.

40. The heat strip as recited in claim 39 wherein said enclosure comprises a plurality of reinforcement ribs spaced-apart between a first end panel and a second end panel to provide support.

41. The heat strip as recited in claim 39 wherein said enclosure comprises a support clip protruding from a bottom surface of said enclosure.

42. The heat strip as recited in claim 40 wherein said enclosure comprises means for retaining the heat cable within said enclosure.

43. The heat strip as recited in claim 42 wherein said means for retaining said heat cable comprises an opening in each of said first end panel, said second end panel and said plurality of reinforcement ribs for inserting and holding said heat cable.

44. The heat strip as recited in claim 39 wherein a controller is connected to said heat cable of said heat strip for turning ON and turning OFF said heat cable in response to predetermined signals from an outside first temperature sensor.

45. The heat strip as recited in claim 44 wherein said controller comprises a display for indicating the temperature within said enclosure, said temperature being measured by a second temperature sensor coupled to said controller and positioned in said enclosure.

46. A heat strip for preventing ice build-up on a roof compnsing:

an enclosure having a predetermined shape for easy insertion under a shingle on the roof;

a heat cable positioned within said enclosure;

a front panel of said enclosure comprises a plurality of spaced-apart notches;

a top surface of said enclosure comprises a plurality of spaced-apart slots; and a support clip, said support clip protrudes from a bottom surface of said enclosure.

47. The heat strip as recited in claim 46 wherein said enclosure comprises a plurality of reinforcement ribs spaced-apart between a first end panel and a second end panel to provide support.

48. The heat strip as recited in claim 46 wherein said predetermined shape for said enclosure comprises a triangular shape for easy insertion under a shingle.

49. The heat strip as recited in claim 47 wherein said enclosure comprises means for retaining the heat cable within said enclosure.

50. The heat strip as recited in claim 49 wherein said means for retaining said heat cable comprises an opening in each of said first end panel, said second end panel, and said plurality of reinforcement ribs for inserting and holding said heat cable.

51. The heat strip as recited in claim 46 wherein a controller is connected to said heat cable of said heat strip for turning ON and turning OFF said heat cable in response to predetermined signals from an outside temperature sensor.

52. The heat strip as recited in claim 51 wherein said controller comprises a display for indicating the temperature within said enclosure, said temperature being measured by a temperature sensor coupled to said controller and positioned in said enclosure.

* * * * *